US005152487A

United States Patent [19]

Defatte et al.

[11] Patent Number: 5,152,487

[45] Date of Patent: Oct. 6, 1992

[54] MOUNTING PLATE

[75] Inventors: Robert G. Defatte; Gary Gill, both of Campbellsport, Wis.

[73] Assignee: Defatte & Associates, Inc., Campbellsport, Wis.

[21] Appl. No.: 753,874

[22] Filed: Sep. 3, 1991

[51] Int. Cl.[5] ..... E05F 3/00; E06B 7/28

[52] U.S. Cl. ..... 248/225.1; 16/66

[58] Field of Search ..... 16/49, 51, 66, 84, 382; 248/225.1; 403/201

[56] References Cited

U.S. PATENT DOCUMENTS

| | | | |
|---|---|---|---|
| 2,926,879 | 3/1960 | Dietrich | 248/223.4 |
| 3,888,445 | 6/1975 | Pence | 16/66 |
| 4,389,133 | 6/1983 | Oberst | 403/201 |
| 4,929,116 | 5/1990 | Mahl | 248/225.1 |
| 5,026;016 | 6/1991 | Lisowski | 248/225.1 |

*Primary Examiner*—John Sipos
*Assistant Examiner*—Donald M. Gurley
*Attorney, Agent, or Firm*—Donald Cayen

[57] ABSTRACT

A mounting plate enables the bracket of a conventional door closer to be removably retained to a door casing or the like. The mounting plate has a pair of tabs that define slots for slidingly receiving the flanges of the closer bracket. A stop permits entry of the closer bracket into the mounting plate slots from only one direction and also limits sliding in that direction. Bumps on the mounting plate cooperate with the closer bracket mounting holes to loosely restrain the closer bracket from sliding out of the mounting plate in the other direction. After the mounting plate is secured to the door casing or the like, the closer bracket is slid into the mounting plate slots, and the closer bracket functions in a completely normal manner. When the closer bracket must be removed to provide full utilization of the door opening, it is necessary only to slide the closer bracket out of the mounting plate. Later, the closer bracket is replaced to its operational position by sliding it back into the mounting plate slot.

7 Claims, 1 Drawing Sheet

MOUNTING PLATE

BACKGROUND OF THE INVENTION

1. Field of the Invention

This invention pertains to mounting devices, and more particularly to apparatus for removably retaining a bracket to a stationary member.

2. Description of the Prior Art

Various products have been developed to close doors. For example, extension springs, weights and pulleys, and torsion hinges are well known and are in widespread use.

Door closers in the form of combination springs and air cylinders are especially popular. The spring and air cylinder door closers work very well, and they have been used in homes and offices for many years. Nevertheless, they do have a disadvantage that can be troublesome. That disadvantage pertains to the amount of space required for the closer bracket that is attached to the door casing. A typical closer bracket is approximately 2.88 inches long from the mounting surface on the door casing to the far end of the closer bracket web. In other words, the bracket extends almost three inches into the opening defined by the door casing. In normal use, that length prevents no problem.

However, occasionally it is necessary to move furniture, appliances, or other wide objects through a doorway having a spring and air cylinder closer. In many of those situations, the three inch protrusion of the closer bracket into the doorway prevents the object from passing through. It then becomes necessary to remove the closer bracket from the door casing. A person must procure a screwdriver or other appropriate tool and spend time removing the screws. The screws must be replaced when the move is completed. In addition to the time required to move and replace the closer bracket, there is the risk of losing the screws. A further detriment concerns the abrasion of the casing material each time the screws are removed and replaced. Eventually, sufficient material for adequately holding the screws in the casing may no longer be available, and repairs to the casing must be made.

Thus, a need exists for improvements in the attachment of door closers to door casings.

SUMMARY OF THE INVENTION

In accordance with the present invention, a mounting plate is provided that enables the bracket of a combination spring and air cylinder door closer to be removably retained to a door casing without the use of fasteners. This is accomplished by designing the mounting plate to be permanently secured to the door casing and to slidingly receive the closer bracket.

The mounting plate is comprised of a generally flat base made of a thin but rigid material. The base has a width approximately equal to the width of the mounting flanges of the door closer bracket. The base includes provisions for securing it to a door casing, such as holes for mounting screws.

The mounting plate further comprises a pair of allochiral tabs, which may be cut and bent from the base. The tabs lie parallel to the base and are spaced from it so as to form two coplanar slots. The slots are sized to slidingly receive associated flanges of the closer bracket.

To limit the sliding of the closer bracket within the mounting plate slots, the base is formed with a stop that extends into the plane of the slots. Because of the stop, the closer bracket can slide into the mounting plate slots from only one direction, and the closer bracket can slide in that direction only until it strikes the stop. Thus, the bracket is captured in five linear directions within the mounting plate. To loosely retain the closer bracket within the mounting plate slots in the sixth direction, the mounting plate base is fabricated with small bumps at locations that correspond to the mounting holes on the closer bracket. The bumps are on the same side of the base as the slots, and the bumps extend a short distance into the corresponding closer bracket mounting holes. In that manner, the closer bracket will not slide out of the mounting plate slots under such low forces as gravity.

In use, the closer bracket is assembled to the mounting plate by sliding the closer bracket flanges into the mounting plate slots until the closer bracket strikes the mounting plate stop. The mounting plate and closer bracket are properly located on the door casing to suit the spring and air cylinder closer. The mounting plate is secured to the door casing, as by screws, and the installation is complete. When installed, the closer bracket is free to slide only in one horizontal direction within the mounting plate. The mounting plate remains on unobtrusively in place, with the closer bracket functioning in a normal manner.

When the full width of the doorway is needed to move large objects through it, it is necessary only to manually push the closer bracket horizontally away from the mounting plate stop with sufficient force to disengage the mounting plate bumps from the closer bracket mounting holes and to slide the closer bracket out of the mounting plate slots. The doorway is then entirely clear. Later, the closer bracket is slid back into the mounting plate, where it remains in place until it again becomes necessary to remove it.

Other advantages, benefits, and features of the invention will become apparent to those skilled in the art upon reading the detailed description of the invention.

DETAILED DESCRIPTION OF THE PREFERRED EMBODIMENT

Figure 2:
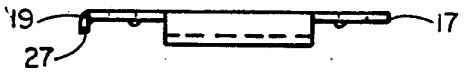
FIG. 2 is a top view of FIG. 1.
Figure 1:
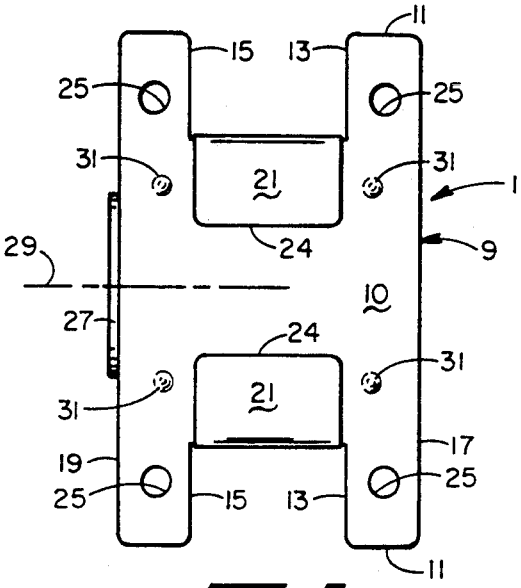
FIG. 1 is a front view of the mounting plate of the present invention.
Figure 3:
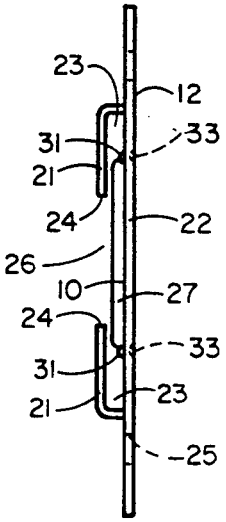
FIG. 3 is a side view of FIG. 1.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to the drawings, a mounting plate 1 is illustrated that includes the present invention. The mounting plate is particularly useful for enabling a bracket 3 used with a spring and air cylinder door closer 5 to be removably retained to a door casing or the like 7. However, it will be understood that the invention is not limited to doorway related applications.

In the preferred embodiment, the mounting plate 1 is comprised of a single piece 9 of material, such as 16 gauge sheet steel. The piece 9 has a base 22 that is generally rectangular in shape, having a height of approximately 3.50 inches and a width of approximately 2.25 inches. The base 9 has a front surface 10 and a back surface 12. Each of the two opposite ends 11 of the base 22 is cut along two lines 13 and 15 for a distance of approximately 0.75 inches from the associated end 11. Each cut 13 and 15 may be approximately 0.50 inches from the base side edges 17 and 19, respectively. The tabs 21 resulting from the cuts 13 and 15 are bent over at 180 degrees to overlie at a spaced distance from the base front surface 10 to form slots 23 between the tabs 21 and the base 22. The gap of each slot is approximately 0.13 inches. The free ends 24 of the two tabs are spaced a distance apart to create an opening 26 between them. A hole 25 is formed near each corner of the base.

The mounting plate 1 is further fabricated with a stop 27 along the base side edge 19. The stop 27 may be in the form of a lip 27 that is integral with the base 22 and that is bent over at 90 degrees from the plane thereof. The lip 27 is preferably approximately 1.25 inches long, and, like the tabs 21 and holes 25, it is symmetrical about the base transverse centerline 29. The width of the base 22 between the side edges 17 and 19 is at least as great as the width of the flanges 35 of the closer bracket 3 with which the mounting plate is used. Similarly, the overall width of the slots 23 is at least as great as the overall height of the closer bracket flanges 35.

In the illustrated construction, the base 22 of the piece 9 is further formed with four bumps 31 on the base top surface 10. Each bump 31 protrudes approximately 0.04 inches above the base top surface. The bumps may be formed by striking the base back surface 12 at locations 33 with a pointed punch. The bumps are located to correspond with the mounting holes 37 of the closer bracket flanges 35, which, in one instance of a commercially available closer bracket, is approximately 0.63 inches on both sides of the base transverse centerline 29 and approximately 0.38 inches from the base side edges 17 and 19.

Figure 4:
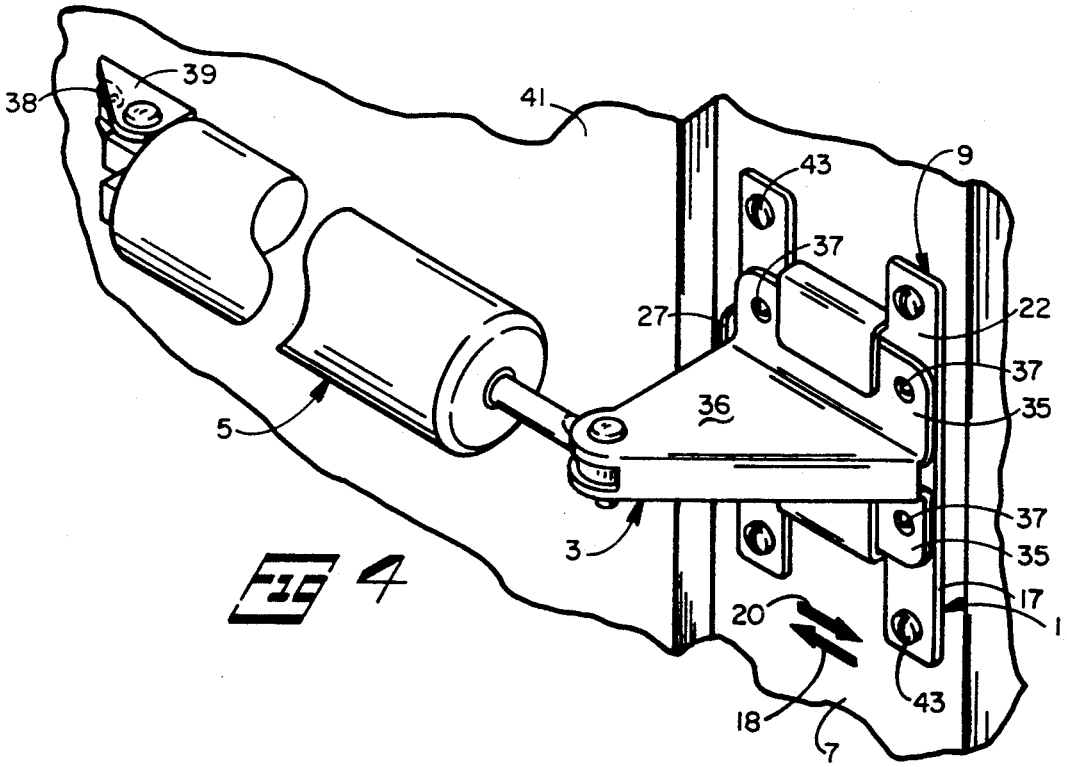
FIG. 4 is a perspective view of the mounting plate in use.

The mounting plate 1 is designed to slidingly receive the conventional door closer bracket 3. The slots 23 formed by the cooperation of the tabs 21 and the base front surface 10 are sized to rather loosely receive the corresponding closer bracket flanges 35. The spacing 26 between the tab free ends 24 is sufficient to allow passage of the closer bracket web 36. Because of the lip 27, the closer bracket can enter the mounting plate slots only from the direction of the side edge 17, i.e., in the direction of arrow 18. Similarly, the lip prevents the closer bracket from sliding completely out of the slots in the direction of arrow 18. When the closer bracket is fully within the mounting plate slots, as shown in FIG. 4, the mounting plate has captured the closer bracket in five linear directions. The bumps 31 protrude slightly into the bracket mounting holes 37 to loosely restrain the bracket against sliding out of the slot in the direction of arrow 20.

The mounting plate 1 is used by sliding the flanges 35 of the door closer bracket 3 into the mounting plate slots 23 in the direction of arrow 18 until the closer bracket contacts the lip 27. At that point, the bumps 31 engage the closer bracket mounting holes 37. The clevice 39 of the spring and air cylinder closer 5 is fastened, as by a screw 38, to the door 41. With the door 41 closed, the assembled mounting plate and closer bracket are oriented such that the closer bracket web 36 is horizontal. The mounting plate and closer bracket are positioned on the door casing 7 to the proper position for the particular closer. Then the mounting plate is secured to the door casing 7 by means of screws 43 or the like passing through mounting holes 25. The closer 5 is then ready for operation.

The door closer 5, with its bracket 3 received within the mounting plate 1, operates in normal fashion in all respects. The outstanding advantage of the mounting plate comes into play when it is necessary to move furniture and the like through the door casing 7 and the closer bracket 3 protrudes into the door opening to prevent such moving. In that situation, the door 41 is closed, and the closer bracket 3 is merely slid in the direction of arrow 20 out of the mounting plate slots 23. The door closer and the closer bracket can then be swung out of the way against the door 41, leaving only the thin mounting plate remaining on the door casing. The furniture can then be moved through the door casing without hindrance. When moving is complete, the door is reclosed and the closer bracket is again assembled to the mounting plate by sliding the closer bracket flanges 35 into the mounting plate slots 23 in the direction of arrow 18. In that manner, the closer bracket can be repeatedly removed and reassembled to the mounting plate in quick and easy fashion without tools and without causing damage to the door casing.

Thus, it is apparent that there has been provided, in accordance with the invention, a mounting plate that fully satisfy the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In combination with a door closer having a bracket with a web and generally planar out turned flanges having mounting holes, a mounting plate that enables the bracket to be removably retained to a door casing comprising:

a. a generally flat and rigid base having at least one mounting hole therein;

b. a pair of allochiral tabs overlying the base, the tabs and base cooperating to define planar slots that slidingly receive the bracket flanges with the bracket web passing between the tabs, the tabs preventing the bracket from moving in directions perpendicular to the directions of bracket sliding when the bracket is fully received within the mounting plate slots such that the mounting plate can be secured to the door casing and the bracket can be slid into and out of the mounting plate slots to thereby enable the bracket to be removably retained to the door casing without fastening the bracket to the door casing; and c. at least one bump formed in the base remote from the slots for cooperating with the bracket mounting holes to loosely restrain the bracket from sliding out of the mounting plate slots.

2. A method of removably retaining a door closure bracket having coplanar flanges with mounting holes therein to a door casing comprising the steps of:

a. providing a mounting plate having a planar base with at least one bump thereon and a pair of spaced allochiral tabs that cooperate with the base to form corresponding slots, the tabs having respective free ends that face each other;

b. orienting the mounting plate such that the free ends of the tabs are aligned horizontally;

c. securing the mounting plate to the door casing; and d. sliding the bracket flanges horizontally into the mounting plate slots and engaging the mounting plate bump with a selected one of the bracket mounting holes to thereby loosely restrain the bracket from sliding out of the mounting plate slots, so that the bracket flanges are captured between the mounting plate base and the tabs.

3. A mounting plate for removably receiving the flanges of a selected bracket comprising:

a. a rigid planar generally H-shaped base having two generally parallel side legs with respective opposed longitudinally extending inner facing edges and a cross leg integral with the inner facing edges of the side legs and extending transversely therebetween, the cross leg having opposed generally parallel edges that extend between the side legs and that are generally perpendicular to the longitudinal inner facing edges of the side legs; and b. a pair of generally L-shaped tabs, each tab having a short leg that is connected to a respective edge of the cross leg and that is perpendicular to the plane thereof and a long leg that overlies the cross leg, the tabs cooperating with the cross leg to create respective planar slots, so that the flanges of the selected bracket can be slid into the slots.

4. The mounting plate of claim 3 further comprising a substantially straight and planar lip joined to one of the base side legs and extending along an outer edge of the side leg and being generally perpendicular to the plane of the base, the lip lying in the plane of the slots to limit sliding of the flanges of the selected bracket within the slots.

5. The mounting plate of claim 3 further comprising at least one bump formed integrally with the base and projecting into the plane of the slots to contact and press against a flange of the bracket to restrain the bracket in place within the slots.

6. The mounting plate of claim 5 wherein the bump is located in one of the side legs of the base.

7. The mounting plate of claim 5 wherein there are two bumps formed in each of the side legs of the base.

* * * * *